US008282186B2

(12) United States Patent
Takei et al.

(10) Patent No.: US 8,282,186 B2
(45) Date of Patent: Oct. 9, 2012

(54) LIQUID EJECTION METHOD FOR EJECTING AN INK CONTAINING A COLOR MATERIAL AND AN IMPROVEMENT LIQUID

(75) Inventors: Yasunori Takei, Tokyo (JP); Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 12/796,458

(22) Filed: Jun. 8, 2010

(65) Prior Publication Data

US 2010/0315470 A1 Dec. 16, 2010

(30) Foreign Application Priority Data

Jun. 10, 2009 (JP) ..... 2009-139371

(51) Int. Cl.
*B41J 29/38* (2006.01)

(52) U.S. Cl. ..... 347/20; 347/21

(58) Field of Classification Search ..... 347/20, 347/21, 43, 54, 101, 102
See application file for complete search history.

(56) References Cited

U.S. PATENT DOCUMENTS 6,805,428 B2 * 10/2004 Otsuki ..... 347/40

FOREIGN PATENT DOCUMENTS

JP 2006-088468 4/2006
JP 2006-272771 10/2006

* cited by examiner

*Primary Examiner* — Juanita D Jackson
(74) *Attorney, Agent, or Firm* — Canon USA Inc. IP Division

(57) ABSTRACT

There is provided a liquid ejecting method using a liquid ejection head including a first ejection port for ejecting an ink containing a color material, a first energy generating element for generating energy utilized for ejecting the ink from the first ejection port, a second ejection port for ejecting an improvement liquid for improving recording property of the ink, and a second energy generating element for generating energy utilized for ejecting the improvement liquid from the second ejection port. The method includes ejecting the ink from the first ejection port by driving the first energy generating element, and ejecting the improvement liquid from the second ejection port by driving the second energy generating element, in a state where a liquid level of the improvement liquid in the second ejection port has moved forward in a liquid ejection direction than a liquid level of the ink in the first ejection port when the first energy generating element is driven.

6 Claims, 12 Drawing Sheets

LIQUID EJECTION METHOD FOR EJECTING AN INK CONTAINING A COLOR MATERIAL AND AN IMPROVEMENT LIQUID

BACKGROUND OF THE INVENTION

1. Field of the Invention

The present invention relates to a liquid ejection method for performing recording by ejecting liquid such as ink onto various types of media such as paper, a liquid ejection apparatus and a liquid ejection head.

2. Description of the Related Art

Among liquid ejection apparatuses, some apparatuses adopt a method for applying a recording property improvement liquid to a recording medium immediately before or after recording operation with an ink, especially for the purpose of higher-image quality or a higher level of fastness of recorded products. Generally, the recording property improvement liquid is colorless and transparent, and recording is performed by overlapping the recording property improvement liquid and the ink. Two liquids are mixed on the recording medium before being absorbed thereinto, and fixed thereon. According to this method, coloring property, water resisting property, reduction in bleeding, and the like of the recording liquid are improved to the recording medium. In particular, in a case where the recording medium is general plain paper on which an ink reception layer such as coating is not applied, recording with less bleeding becomes preferably possible.

When the recording property improvement liquid is ejected, a droplet that impacts on the recording medium (hereinafter, main droplet), and a sub-droplets which accompanies the main droplet and is smaller than the main droplet (hereinafter, satellites) are generated. Among the satellites, some ones with particularly minute particle size (hereinafter, mists) may float into a printer machine without impacting on the recording medium. The floating mist may adhere near an ejection port serving as an opening portion through which an ink is ejected, by an influence of an air stream generated between a liquid ejection head and the recording medium. The adhered mist may react with the ink and contaminate surroundings of the ejection port. In this case, the adhered mist may derange an ejection direction of the ink, and in some cases, it may clog and hinder the opening portion from ejecting the liquid.

To cope with such a problem, for example, Japanese Patent Application Laid-Open No. 2006-088468 and Japanese Patent Application Laid-Open No. 2006-272771 discuss a mechanism for recovering mists in order to prevent the mists from adhering to an orifice surface of the liquid ejection head where the ejection ports are formed.

However, either of these methods uses a means for recovering the mists after the mists have been generated, and all minute mists generated cannot be entirely recovered, while complicated air stream is generated within a recording apparatus. In a case of a large-sized liquid ejection head with a number of nozzles, since a large amount of improvement liquid will be ejected at the same time, mists of the improvement liquid floating without being recovered will be increased. In this case, it is difficult to avoid the improvement liquid from adhering to the orifice surface of the liquid ejection head.

SUMMARY OF THE INVENTION

The present invention is directed to reducing adherence of mists of an improvement liquid to the vicinity of an ejection port which ejects a colored ink.

According to an aspect of the present invention, there is provided a method for ejecting a liquid using a liquid ejection head, wherein the liquid ejection head includes a first ejection port configured to eject an ink containing a color material, a first energy generating element configured to generate energy utilized for ejecting the ink from the first ejection port, a second ejection port configured to eject an improvement liquid for improving recording property of the ink, and a second energy generating element configured to generate energy utilized for ejecting the improvement liquid from the second ejection port. The method includes ejecting the ink from the first ejection port by driving the first energy generating element, and ejecting the improvement liquid from the second ejection port by driving the second energy generating element, in a state where a liquid level of the improvement liquid in the second ejection port has moved forward in a liquid ejection direction than a liquid level of the ink in the first ejection port when the first energy generating element is driven.

With the above-described configuration, mists of the improvement liquid can be suppressed by performing an ejection operation in a state where a meniscus of the improvement liquid is raised from an orifice surface. Accordingly, adherence of the mists of the improvement liquid to the vicinity of the ejection port which ejects the colored ink can be reduced, so that a stable ejection operation can be realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 11:
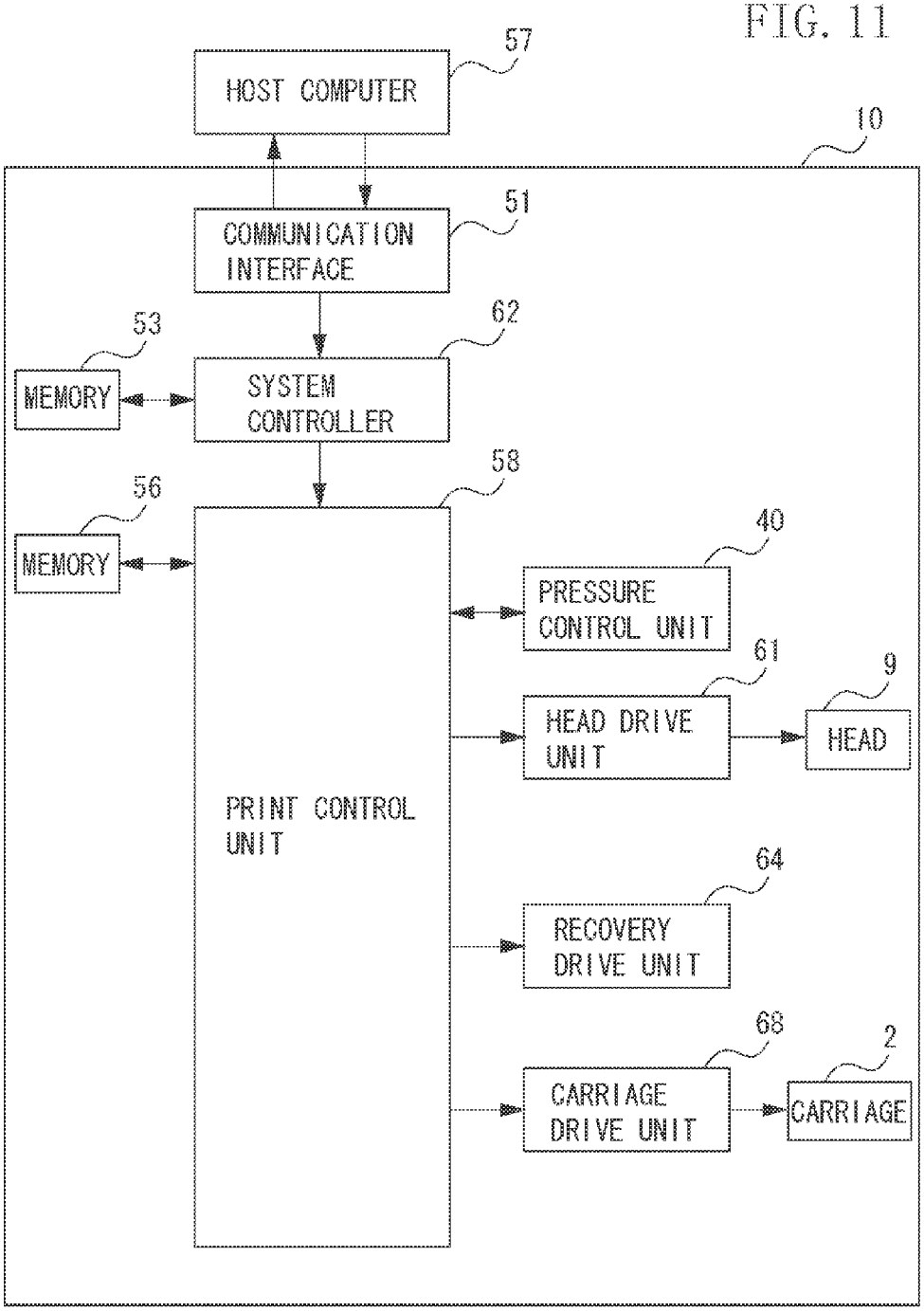
FIG. 11 is a block diagram illustrating a general configuration of the liquid ejection apparatus according to the exemplary embodiments of the present invention.

FIG. 11 is a block diagram illustrating an example of a general configuration of a liquid ejection apparatus 10 according to the present invention. The liquid ejection apparatus 10 mainly includes a liquid ejection head 9, a carriage 2, a carriage drive unit 68, a communication interface 51, a system controller 62, memories 53 and 56, a print control unit 58, a head drive unit 61, a pressure control unit 40, and a recovery drive unit 64.

The communication interface 51 receives image data transmitted from a host computer 67. A wired or wireless interface such as Universal Serial Bus (USB), and IEEE 1394 can be applied to the communication interface 51. The image data received by the liquid ejection apparatus 10 via the communication interface 51 is temporarily stored in a first memory 53 for image data storage.

The system controller 62 includes a microcomputer, its peripheral circuits, and the like, and controls the entire liquid ejection apparatus 10 in accordance with a predetermined program. More specifically, the system controller 62 controls each unit of the communication interface 51, the print control unit 58, and the like. The print control unit 58 includes a microcomputer, its peripheral circuits and the like, and controls the head drive unit 61 and the pressure control unit 40 in accordance with a predetermined program. The print control unit 58 generates data (dot data) necessary for forming dots onto the recording medium by the liquid ejection head 9 performing ejection toward the recording medium, based on the image data input to the liquid ejection apparatus 10. More specifically, the print control unit 58 generates the dot data for ejection from the image data in the first memory 53, according to the control of the system controller 62, and supplies the generated dot data to the head drive unit 61. The second memory 56 is provided for the print control unit 58, and the dot data and the like are temporarily stored in the second memory 56 at the time of image processing in the print control unit 58.

The head drive unit 61 generates a drive signal for causing the liquid ejection head 9 to eject an ink based on the dot data supplied from the print control unit 58 according to an instruction of the print control unit 58, and supplies the drive signal to the liquid ejection head 9. The pressure control unit 40 controls pressures according to the instruction of the print control unit 58. The recovery drive unit 64 performs ink suction, wiper movement, and preliminary ejecting operation of the liquid ejection head 9 according to the instruction of the print control unit 58. The carriage drive unit 68 supplies a drive signal for reciprocating operation of the carriage 2 to the carriage 2 according to the instruction of the print control unit 58. In FIG. 11, the system controller 62 and the print control unit 58 are represented separately, but they may be constituted by one microcomputer.

Figure 1:
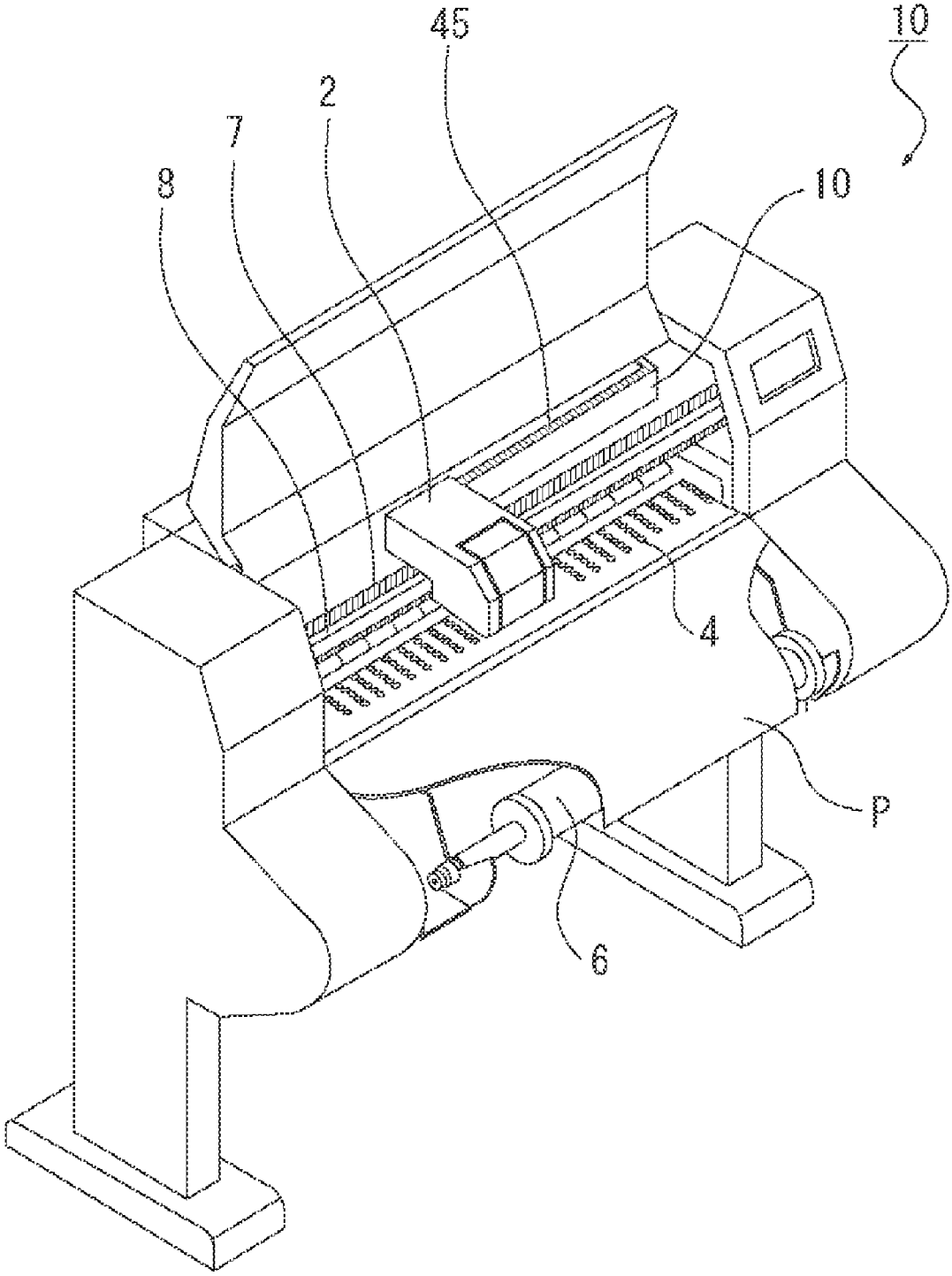
FIG. 1 is a schematic view of a liquid ejection apparatus according to an exemplary embodiment of the present invention.

FIG. 1 is a perspective view illustrating an appearance of an ink-jet printer that is one exemplary embodiment of the liquid ejection apparatus according to the present invention. A recording apparatus illustrated in FIG. 1 is a serial scan type printer and forms an image by scanning with the liquid ejection head in a direction (main scanning direction) perpendicular to a conveyance direction of a recording medium P.

A configuration of the printer and an outline of operations during a recording operation will be described below with reference to FIG. 1. First, the recording medium P is conveyed by a sheet feed roller 6 driven via gears by a sheet feed motor (not shown). On the other hand, a carriage motor (not shown) causes the carriage 2 to scan along a guide shaft 8 extending in the direction perpendicular to the above-described conveyance direction at a predetermined conveyance position. Then, the printer causes the ejection port of the liquid ejection head attached on the carriage 2 to eject the ink at timing based on a positional signal obtained by an encoder 7 in the scanning process, and performs recording for a certain bandwidth corresponding to an ejection port array range. The liquid ejection head is detachably attached to the carriage 2. Further, the printer is configured to convey the recording medium and perform recording for the next bandwidth.

A flexible wiring substrate 19 for supplying a signal pulse for an ejection drive, a signal for head temperature adjustment, and the like is attached to the liquid ejection head. The other end of the flexible wiring substrate 19 is connected to a control circuit provided with a control circuit that executes control of the printer. To the liquid ejection head mounted on the carriage 2, each color ink is independently supplied from ink tanks each storing six-color inks, passing through ink supply tubes 45 and via a sub-tank 46, as described below with reference to FIGS. 2 and 3. A recovery system unit of the liquid ejection head for performing an ejection recovery operation is provided in a part of movable range of the carriage 2, for example, a home position of the liquid ejection head.

The fed recording medium P is pinched and conveyed by a sheet feed roller 6 and a pinch roller (not shown), and is guided to a recording position (scan region of the liquid ejection head) on a platen 4. In a normal rest state, since capping is provided on a face plane of the liquid ejection head, a cap is opened before the recording operation for enabling the liquid ejection head or the carriage 2 to perform scanning. Then, when data for one scan is accumulated in a buffer, the carriage 2 is caused to perform scanning, and performs recording as described above.

Figure 3:
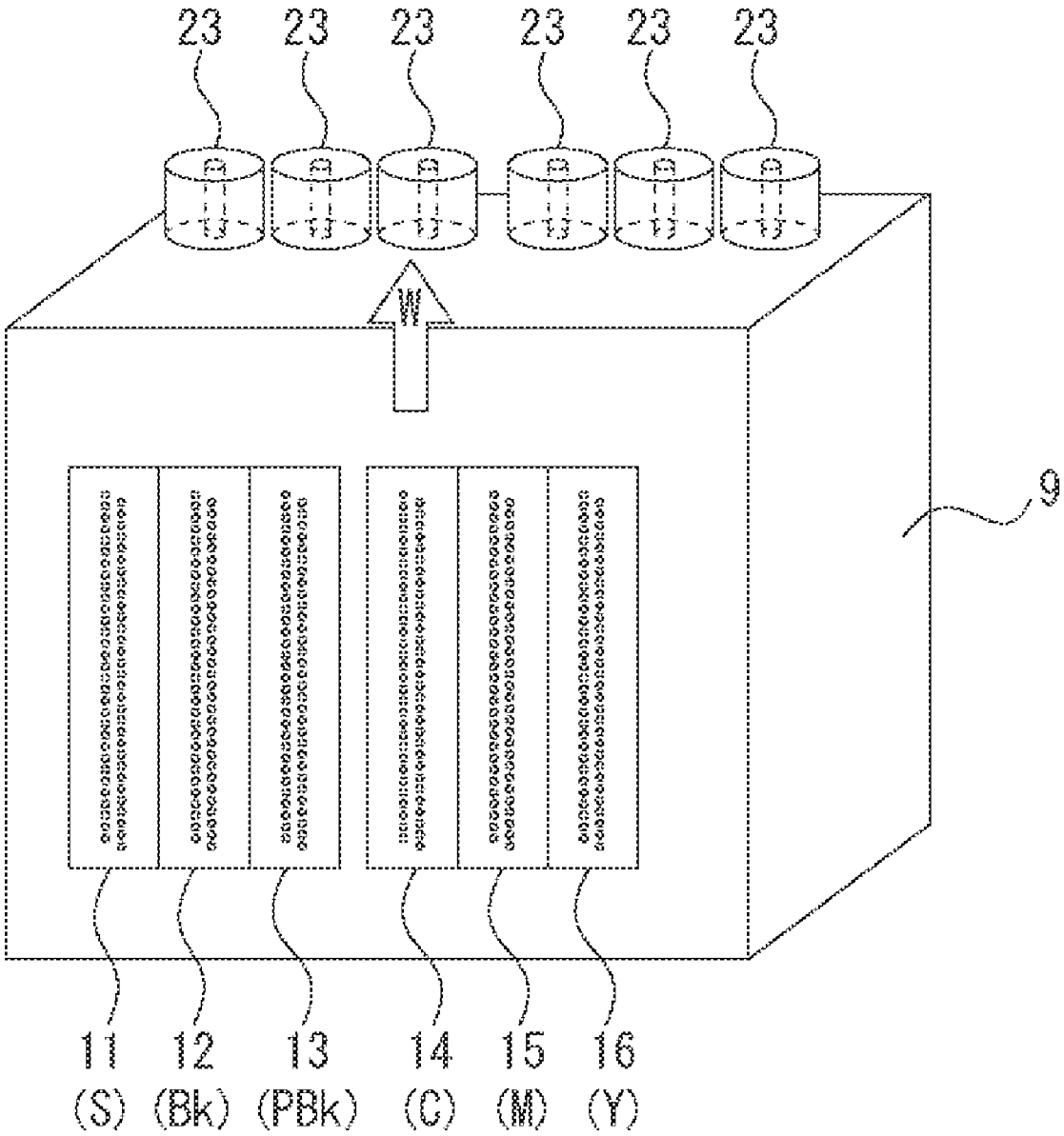
FIG. 3 is a schematic view of a liquid ejection head mounted on the liquid ejection apparatus according to the exemplary embodiment of the present invention.

FIG. 3 is a schematic perspective view illustrating the liquid ejection head 9 mounted on the carriage 2 of the above-described printer from a direction in which the inks are ejected. The liquid ejection head 9 includes an ejection portion 11 provided with a plurality of ejection ports (second ejection ports) for ejecting the improvement liquid (S) that improves recording property of the inks. Further, there are arranged therein the ejection portions 12 to 16 provided with a plurality of ejection ports (first ejection ports) for ejecting inks with different color tone including color materials of, for example, black (Bk), photo black (PBk), cyan (C), magenta (M) and yellow (Y). There are formed energy generating elements (first energy generating elements) for generating energy utilized for ejecting the inks corresponding to the respective ejection ports. To each of the ejection portions, the ink is supplied from an ink introduction portion 23 via a tank inside the liquid ejection head and an ink flow path. To the ink introduction portion 23, the ink is introduced via a tube from an ink as will be described below.

Figure 4:
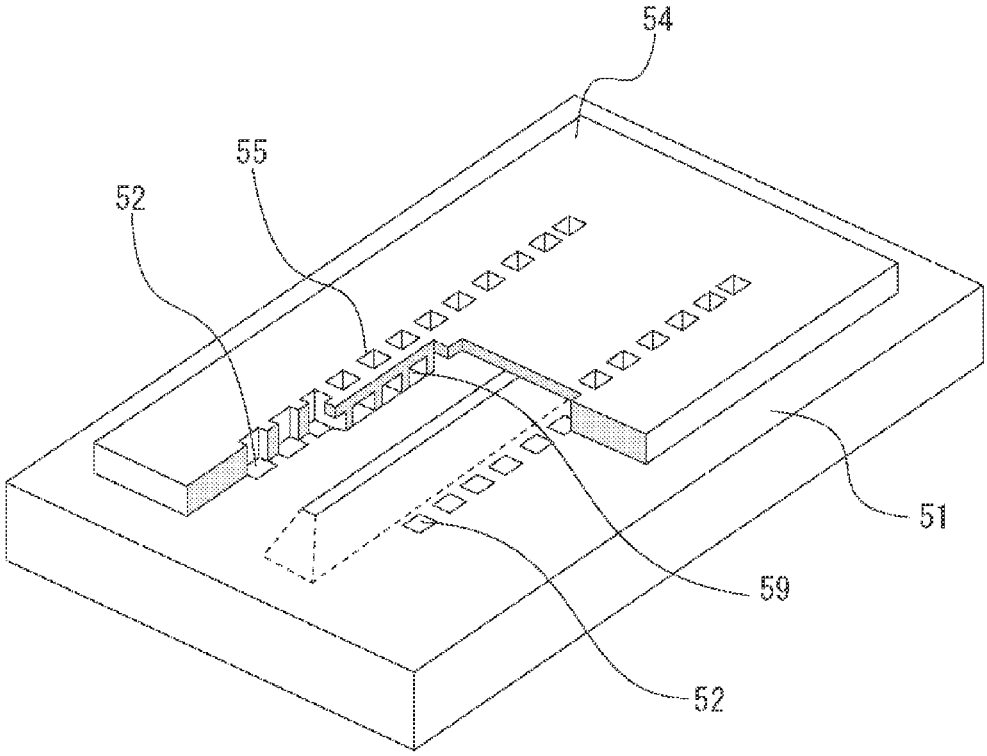
FIG. 4 is a schematic perspective view illustrating an ejection portion of the liquid ejection head applicable to the first exemplary embodiment of the present invention.

FIG. 4 is a schematic perspective view illustrating each ejection portion of the liquid ejection head 9. Each of the ejection portions includes an energy generating element 52 for generating energy utilized for ejecting the inks. According to the present exemplary embodiment, there is provided a device using thermal energy (hereinafter, heater) for producing film-boiling on the ink in response to electrification of the heater. On a substrate 51, heaters 52 are arranged at a predetermined pitch, and heater rows are parallel arranged. Between the heater rows of the substrate 51, a member (orifice plate) 54 in which the ejection ports 55 and the ink flow paths 59 are formed is joined together to the substrate 51, so that the ejection portion are configured.

In each heater row, desired recording resolution is realized by arranging the heaters 52 and the ejection ports 55 in a staggered configuration half pitch apart from one another. In this case, each of the ejection portions 11 through 16 may have the same recording density and number of the ejection ports, or may have different recording density and number of the ejection ports.

Figure 2:
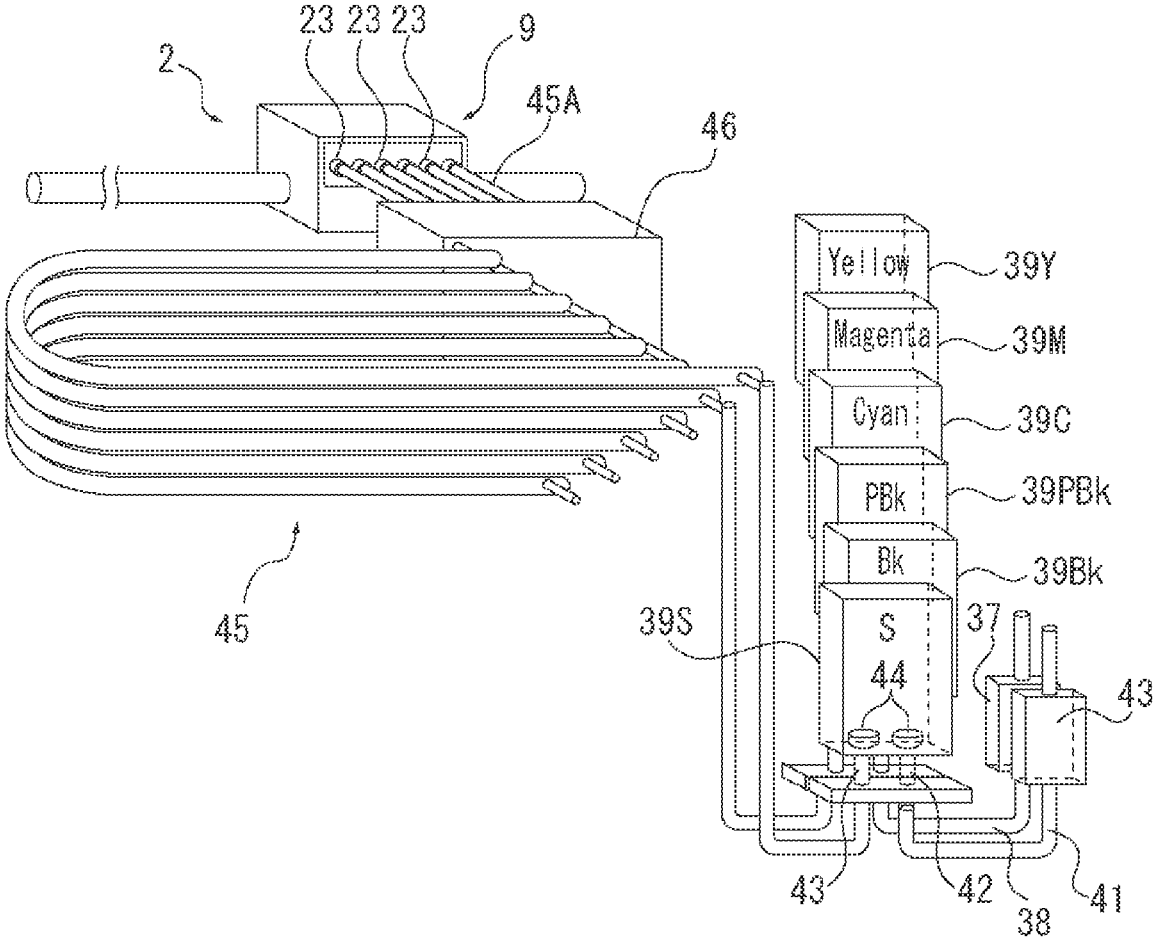
FIG. 2 is a schematic view of an ink supply system applicable to a first exemplary embodiment of the present invention.

FIG. 2 is a schematic perspective view illustrating a configuration example of an ink supply system to the above-described liquid ejection head or the ejection portions. There are mainly available two systems for supplying the inks to the liquid ejection head or the ejection portions. One is to mount an ink tank for storing an ink on the carriage, and to supply the ink directly to the liquid ejection head. Another is to supply the ink by connecting between the ink tank arranged at a predetermined area of the apparatus and the liquid ejection head mounted on the carriage using a tube referred to as an ink supply tube. This system is adopted to the present exemplary embodiment.

In the ink tanks 39S, 39Bk, 39PBk, 39C, 39M and 39Y, the improvement liquid (S) and inks of black (Bk), photo black (PBk), cyan (C), magenta (M) and yellow (Y) are stored, respectively. Ink supply tubes 45 connected to respective ink tanks have enough movability which can follow a movement (scanning) of the carriage 2 or the liquid ejection head 9.

Each of the ink tanks are molded by an injection blow or the like with polypropylene (PP), polyethylene (PE) or other resins, and are assembled by using techniques such as ultrasonic welding, thermal welding, and adhesion. In FIG. 2, an ink tank of a type, in which a tank exterior functions as an ink chamber as it is, is exemplified, and a joint rubber 44 is arranged on its bottom. On the other hand, a hollow needle 43 provided at the end of the ink supply tube 45 penetrate through the joint rubber 44 and enter into the ink chamber, so that the ink is supplied. An atmosphere communication pipe 41 is connected to each ink tank via the hollow needles 42, and air is supplied into the ink chamber via the hollow needle 42 as the ink is consumed, so that an internal pressure of the ink tank can be maintained at substantially constant. The negative pressure acting on the liquid ejection head is generated by water head difference between the ejection port 55 and a meniscus formed at an opening of the hollow needle 42. In FIG. 2, a buffer chamber 37 is formed to an atmosphere communication pipe 38 connected to the ink tank 39Bk. Though omitted in FIG. 2, the ink tanks of other colored inks have the similar configurations. When pressure change occurs within the ink chamber due to environmental change or the like, the atmosphere communication pipe and the buffer chamber perform a function of absorbing the pressure change and reducing an influence of a pressure fluctuation to the ink supply tube 45 and eventually the liquid ejection head 9 side. According to the present exemplary embodiment, a pump 40 for pressure adjustment is connected to only the ink tank 39S for storing the improvement liquid, and a positive pressure or a negative pressure of the improvement liquid is adjusted by introducing or exhausting air. Therefore, a position of a liquid level of the improvement liquid in the ejection port (second ejection port) for ejecting the improvement liquid can be brought into a state which is moved forward in an ejection direction than a liquid level of the inks in the ejection ports (first ejection ports) for ejecting the inks. It becomes possible to reduce mists of the improvement liquid as described below by ejecting the improvement liquid while driving the heater under this state.

The recovery system unit including the caps for capping the ejection ports 55 of the liquid ejection head and wiper blades is arranged near a home position within a movement region of the carriage 2.

Figure 5:
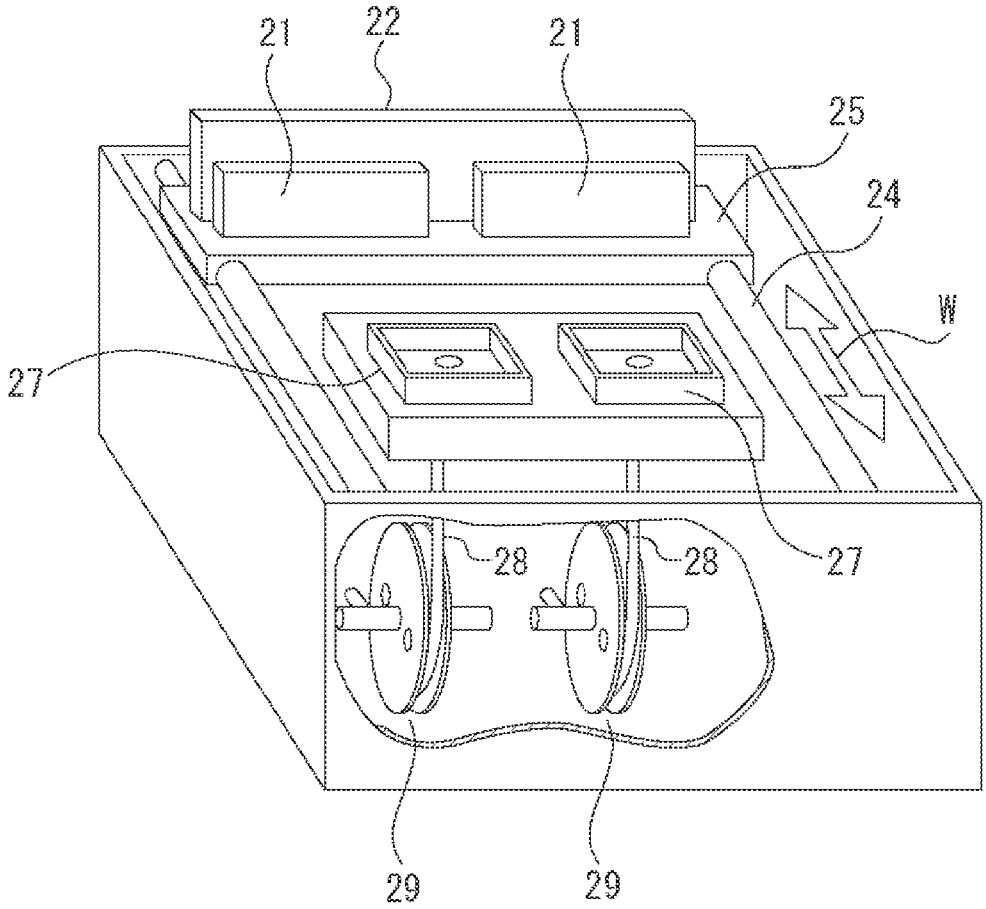
FIG. 5 is a schematic perspective view illustrating a configuration example of a recovery system unit of the liquid ejection apparatus according to the exemplary embodiment of the present invention.

FIG. 5 is a schematic perspective view illustrating a configuration example of the recovery system unit. The caps 27 are elevatably supported, and in an ascent position, capping is performed for each of the face planes on which the ejection ports 55 in, for example, three ejection portions in the liquid ejection head are formed. Accordingly, during a non-recording operation, protection of the face planes or suction recovery can be performed. During recording operation, the caps 27 are set at a descent position at which interference with the liquid ejection head 9 is avoided and can be subjected to preliminary ejection by causing the caps to face the face plane.

Wiper blades 21 and 22 are made of elastic member such as rubber and fixed to a wiper holder 25. The wiper holder 25 is movable along a guide 24 in a front-back direction of the drawing indicated by an arrow W (array direction of the ejection ports in the ejection portions). When the liquid ejection head 9 reaches the home position, the wiper holder 25 moves in the arrow W direction and performs a wiping operation. When the wiping operation is finished, the carriage is retracted outside a wiping region, and subsequently is returned to a position where the wiper does not interfere with the face planes or the like. In the present exemplary embodiment, there are provided two wiper blades 21 that wipe the face planes of three ejection portions as a unit, and the wiper blade 22 that wipes the whole surface of the liquid ejection head 9 including the ejection surfaces of the ejection portions 11 through 16.

A suction pump 29 performs suction by generating the negative pressure in a state where the caps 27 are joined together to the face planes to form an enclosed space in the interior thereof. By the suction, the ink can be filled up from the ink tanks into the liquid ejection head or the ejection portions. Further, dusts, adhesive particles, bubbles, etc., which exist in the ejection ports or inner ink paths can be removed by the suction. In the example shown in drawing, the suction pumps 29 in the form of a tube pump are used. More specifically, a roller rotates while squashing a flexible tube on curved surface forming member by rotating a roller supporting portion in a predetermined direction. Accordingly, the negative pressure is generated in the enclosed space formed by the cap 27, so that the ink is sucked through the ejection port, and inhaled from the cap 27 into the tube or the suction pump. On the other hand, the inhaled ink is further transferred toward an appropriate member (waste ink absorber).

The suction pump 29 can be operated not only for such suction recovery, but also for discharging the ink that is received by the cap 27 by a preliminary ejecting operation performed in a state where the cap 27 is facing the face planes. When the ink subjected to the preliminary ejection and reserved in the caps 27 reaches a predetermined amount, the ink reserved in the caps 27 can be transferred to the waste ink absorber via the tube 28 by operating the suction pump 29.

Figure 12:
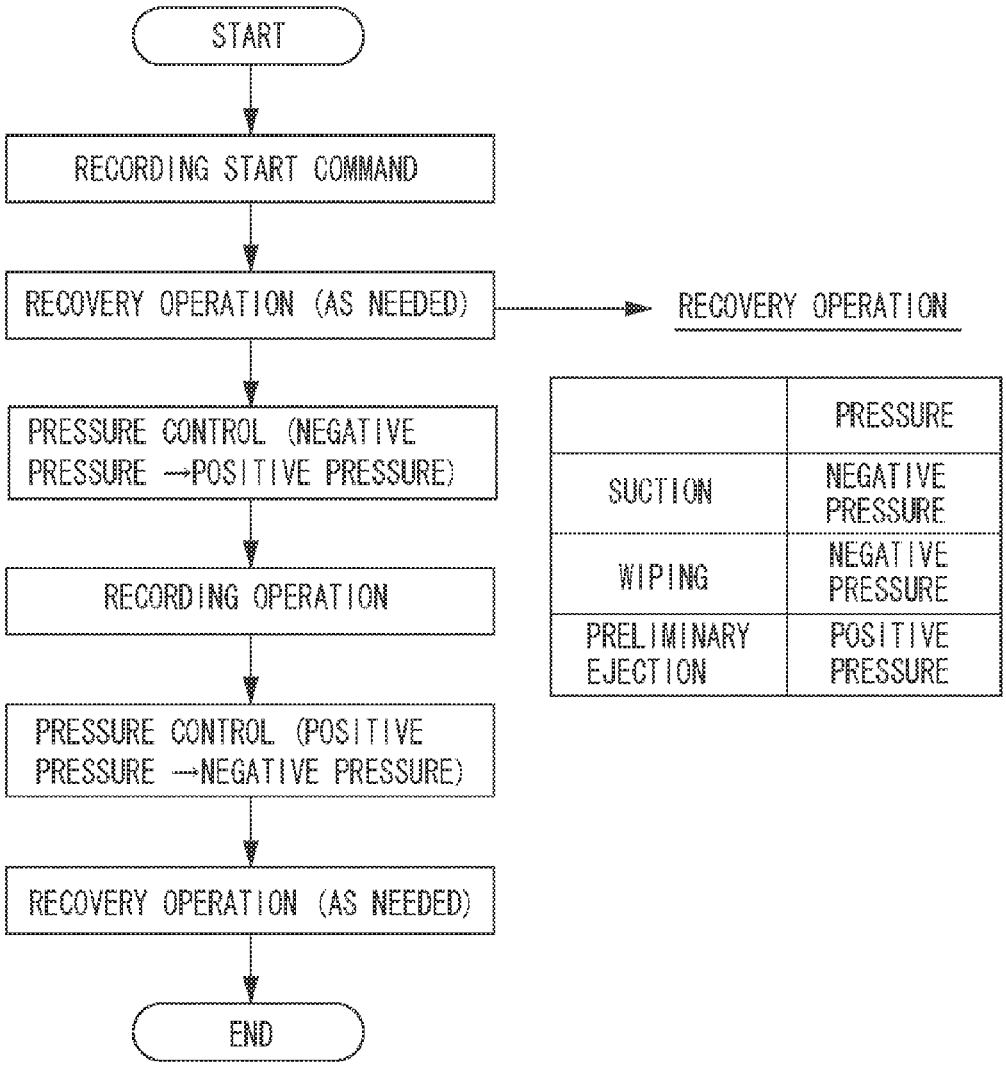
FIG. 12 is a flowchart illustrating a pressure control according to the exemplary embodiments of the present invention.

FIG. 12 is a flowchart illustrating a pressure control on the improvement liquid by the liquid ejection apparatus according to the present invention.

First, when a recording start command is input according to an instruction of a user, the liquid ejection apparatus executes the recovery operation of the liquid ejection head 9 maintained in a capping state as the need arises. Regarding the recovery operation, the liquid ejection apparatus performs pressure control corresponding to each operation of the ink suction, the wiping, and the preliminary ejection, as illustrated in FIG. 12. In the pressure control of the improvement liquid according to the present exemplary embodiment, the ink suction is performed at a negative pressure for preventing an excessive suction, and the wiping is also performed at a negative pressure for preventing an ink sagging due to a meniscus breakage during a wiper contact. The preliminary ejection is performed at a negative pressure similarly to the normal recording operation, in order to suppress the mists.

After completion of the recovery operation, the liquid ejection apparatus performs the pressure control so as to form a positive pressure in the improvement liquid, and starts the recording operation. After completion of the recording operation, the liquid ejection apparatus performs again the pressure control so as to adjust the positive pressure to the negative pressure. Then, the liquid ejection apparatus performs the recovery operation as the need arises, provides capping on the liquid ejection head, and terminates a series of the operations.

Next, an ejection mechanism for suppressing the ink mists of the improvement liquid will be described with reference to FIGS. 6A through 6I and FIGS. 7A through 7I.

FIGS. 6A through 6I are cross sectional views of a portion of the ejection portion, and schematic views illustrating an appearance of how a liquid flies when an ejection operation is performed in a state where a meniscus is raised from the orifice surface by a positive pressure provided on the ejected liquid within the liquid ejection head by the pressure control mechanism. FIGS. 7A through 7I are schematic views illustrating an appearance of how the liquid flies when the ejection operation is performed in a normal meniscus state, namely in a state where the liquid level is flat relative to the ejection port surface or a little retracted in opposite side relative to the ejecting direction. In FIGS. 6F through 6I, a liquid portion that forms an image of the ejected liquid after a liquid droplet left from the ejection port is assumed to be a main droplet portion 105, and a sub-droplet that is smaller than the main droplet is assumed to be a satellite portion 106. In addition, after the main droplet portion 105 and the satellite portion 106 have been separated from each other, it is assumed that the satellite portion includes a leading edge portion 107 and a trailing edge portion 108. For the sake of description of a mechanism, in FIGS. 6A through 6I, a liquid component 101 which is contained inside the ejection port, and a liquid component 100 in which a meniscus is raised from the orifice surface and not surrounded by a nozzle wall, are separately illustrated. According to the present exemplary embodiment, the liquid component 100 and the liquid component 101 are described distinguishably from each other to facilitate understanding.

Figure 6A:
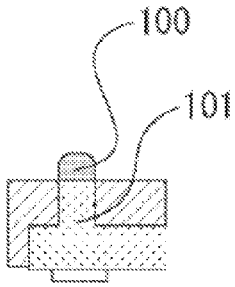
FIGS. 6A through 6I are schematic views illustrating behavior of liquid in an ejection process according to the exemplary embodiment of the present invention.
Figure 6B:
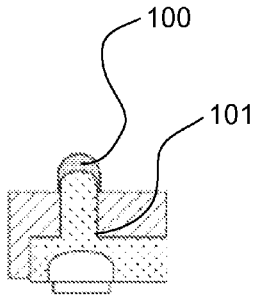
Figure 6C:
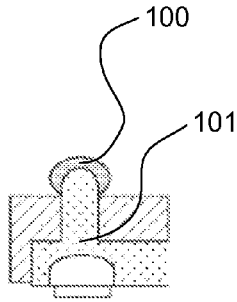
Figure 6D:
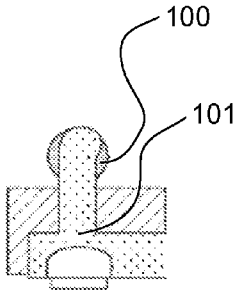
Figure 6E:
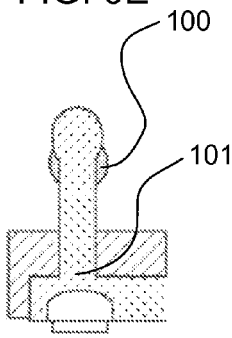
Figure 6F:
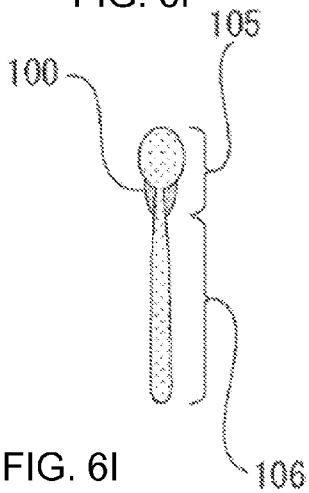
Figure 6G:
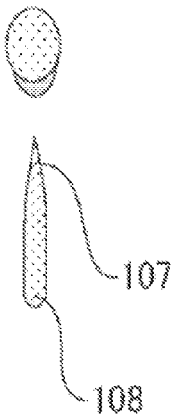
Figure 6H:
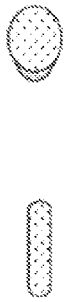
Figure 6I:
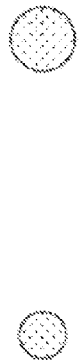
Figure 7A:
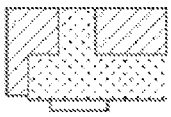
FIGS. 7A through 7I are schematic views in a conventional ejection method.
Figure 7B:
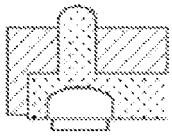
Figure 7C:
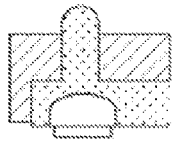
Figure 7D:
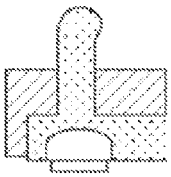
Figure 7E:
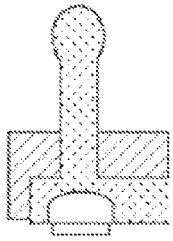
Figure 7F:
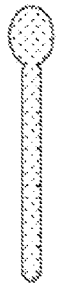
Figure 7G:
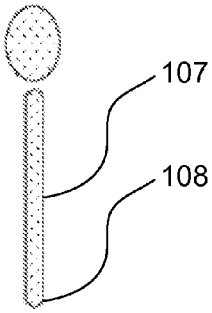
Figure 7H:
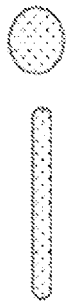
Figure 7I:
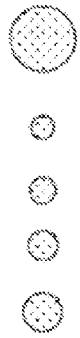

FIG. 6A illustrates an initial state before the ejection operation and in which the meniscus is raised from the orifice surface (ejection port surface). When the heater is driven to supply an ejection energy to the ink in a state where the liquid level is thus raised, as illustrated in FIG. 6B, the energy is transmitted to the liquid component 101 surrounded by the nozzle wall as an energy to head it toward the ejecting direction. Thus, the liquid component 101 is pushed out of the nozzle. However, the energy is not sufficiently transmitted as energy for pushing out to the ejecting direction to a raised liquid portion, namely the liquid component 100, which is not surrounded by the nozzle wall. As a result, as illustrated in FIGS. 6C and 6D, the liquid component 101 moves to the ejecting direction in a way to push away the liquid component 100 from inside, and forms a state in which the central part of the ejected liquid constituted by the liquid component 101 is surrounded by the liquid component 100. As the ejection process progresses, as illustrated in FIG. 6E, the liquid component 100 moves gradually from the leading edge portion toward the rear of the ejected liquid. Then, when the ejected liquid leaves from the ejection port as illustrated in FIG. 6F, the ejected liquid forms the main droplet portion 105 that forms an image and the satellite portion 106. At this time, the liquid component 100 with a slower velocity compared with that of the main droplet portion 105 is located at a connection portion between the main droplet portion 105 and the satellite portion 106, and reduces the velocity of the satellite portion 106. Then, as illustrated in FIG. 6G, the main droplet portion 105 and the satellite portion 106 are separated from each other. At this point, the leading edge portion 107 and the trailing edge portion 108 of the satellite portion have respective velocities V(107), and V(108). Since the satellite leading edge portion 107 is slowed down as described above, which gives: V(107) V(108), thus the satellite portion 106 contracts rapidly. Then, the liquid component 100 is absorbed into the main droplet portion 105. The satellite portion 106 forms one large satellite while transforming into a spherical shape.

On the other hand, in FIGS. 7A through 7I illustrating an ejection in a normal meniscus state, such a force that actively slows down the satellite leading edge portion 107 as illustrated in FIGS. 6A through 6I does not act, and the main droplet portion and the satellite portion are separated from each other by a surface tension of the liquid. Therefore, reduction of the velocity of the satellite portion leading edge portion 107 is relatively gentle after the main droplet portion 105 and the satellite portion 106 have been separated from each other, and the satellite portion 106 is separated into a plurality of satellites by the surface tension of the liquid before the satellite portion 106 contracts in a length direction.

Table 1 is results of measuring respective velocities of the main droplet portion 105, the satellite leading edge portion 107, and the satellite trailing edge portion 108 by observing ejected liquid droplets using an actual liquid ejection head. The same liquid ejection head is used, and in the table, ejection in a state where a meniscus is raised (raised) and ejection in a state where a meniscus is not raised (normal) are compared.

As shown in Table 1, in the ejection in the normal meniscus state, the velocity V(107) of the satellite leading edge portion 107, and the velocity V(108) of the satellite trailing edge portion are in a relationship of V(107)>V(108). Thus, the satellite portion 106 split into a plurality of satellites while elongating, each has flown without cohering together, and a number of the satellites were six. These satellites further split into even smaller sub-droplets, thus floating mists are generated.

In contrast to this, in an ejection method according to the present invention, V(107) V(108) is obtained, and the satellite portion contracts and coheres to form one piece of the satellite. According to the actual study in this way, it can be understood that a method for performing the ejection by raising the meniscus is markedly effective for reduction of the satellites and reduction of the floating mists.

TABLE 1

| Ejection Method | Velocity [m/s] V(105) | V(107) | V(108) | Number of Satellites (Pieces) |
|---|---|---|---|---|
| Normal | 14.9 | 10.9 | 9.6 | 6 |
| Raised | 13.5 | 3.1 | 10.4 | 1 |

As described above, as a result of closely study by the present inventors, it was found that the ejection in a state where the meniscus is raised, is significantly effective for suppression of the floating mists. Conversely, the above-described ejection method may be not suitable in some cases for ejection of a colored ink containing a color material since a particle size of the generated satellites become large. In other words, when a large satellite impacts on a position separate from the main droplet on the recording medium, dots of the satellite are conspicuous and an image quality may be degraded. When properties such as the surface tension of the ink are degraded due to temperature rise of the liquid ejection head or the like, the raised state of the meniscus may be changed. Further, change in the raised state of the meniscus involves change in an ejection amount of the ink and thus causes variation of the ejection amount.

However, by applying the method for ejecting the liquid in the state where the meniscus is raised according to the present invention, only to the colorless and transparent improvement liquid, the dots are not conspicuous on the recording medium. Therefore, problems such as the large satellite dots and variations of the ejection amounts can be permitted. Further, since the floating mists can be suppressed, it can reduce adherence of the floating mists of the improvement liquid to the face plane of the ejection head for colored ink.

As described above, in the ejection method according to the present invention, the raised meniscus may reduce the velocity of the satellites leading edge portion 107 in the ejection process, so that the satellite portion 106 can contract and generation of the floating mists can be suppressed.

When the improvement liquid is continuously ejected from multiple nozzles, there is assumed a case where some ejections can not be performed in the state where the meniscus is raised depending on ejection timing or the like. However, if the ejection operation is predominantly performed in the state where the meniscus is raised, it has a sufficient effect on the reduction of the floating mists which is included in the present invention.

Next, an exemplary embodiment that has embodied the present invention will be described below with reference to FIG. 8. In a second exemplary embodiment, pressure control means in the first exemplary embodiment is changed, but other configurations thereof are the same as those in the first exemplary embodiment. Thus, only the pressure control means will be described below, and duplicate descriptions thereof will be omitted.

Figure 8:
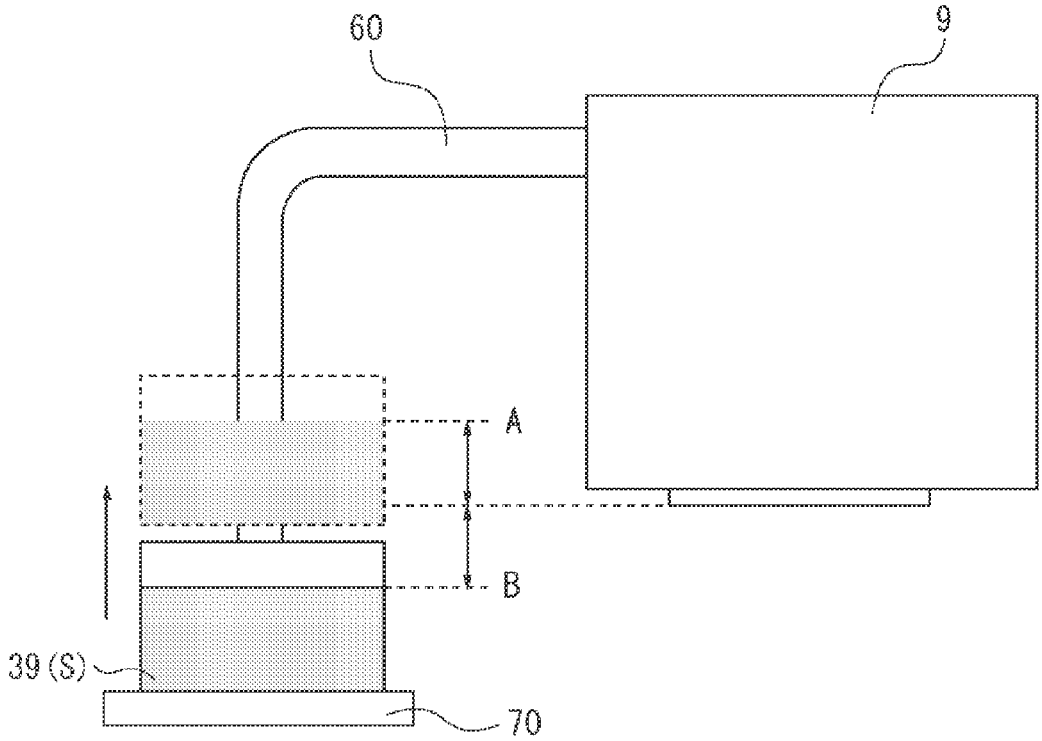
FIG. 8 is a schematic view of an ink supply system applicable to a second exemplary embodiment of the present invention.

In FIG. 8, a supply tube 60 is connected to the top of an ink tank 39(S) in which the improvement liquid is filled up. The supply tube 60 is connected to the liquid ejection head 9, and the improvement liquid is supplied to the liquid ejection head. The ink tank 39(S) is supported by an elevating unit 70 serving as a pressure adjusting mechanism. The elevating unit 70 can move the ink tank 39(S) in a vertical direction. A position of the ink tank 39(S) may be lowered by driving the elevating unit 70 to a negative pressure position (B) in a relationship to a height position of the orifice surface of the liquid ejection head 9. Conversely, the ink tank 39(S) may be raised by driving the elevating unit 70 to a positive pressure position (A). The vertical movement of the ink tank 39(S) is synchronized with the ejection operation and the recovery operation as described in the first exemplary embodiment, and the elevating unit 70 is driven to constantly and appropriately control the positive and negative pressures. For example, according to the present exemplary embodiment, a liquid level control in the ejection port can be performed by arranging the improvement liquid tank for storing the improvement liquid at an upper level than the ink tank. In other words, it can be formed a state in which a position of liquid level of the improvement liquid in the ejection port for ejecting the improvement liquid has moved forward in the ejecting direction than a liquid level of the ink in the ejection port for ejecting the ink. The mists of the improvement liquid can be reduced by ejecting the improvement liquid by driving the heaters in such a state as described below. After ejection of the improvement liquid, a liquid level (meniscus position) in the ejection port vibrates. More specifically, the liquid level repeats forward and backward movement. After the vibration has stopped, it is preferable not to drive the heater for ejection until a position of liquid level of the improvement liquid in the ejection port moves forward in the ejecting direction than the liquid level of the ink in the ejection port for ejecting the ink.

As described above, the meniscus is raised by adjusting the water head difference, and therefore the ejection operation with few mists can be performed similarly to the first exemplary embodiment.

Next, another exemplary embodiment that has embodied the present invention will be described with reference to FIG. 9 and FIGS. 10A through 10C. In a third exemplary embodiment, the pressure control means in the first exemplary embodiment is changed, and pressurizing means is provided at an ejection portion in the liquid ejection head. The other configurations thereof are the same as those in the first exemplary embodiment. Thus, only the pressurizing means provided to the ejection portion will be described below.

Figure 9:
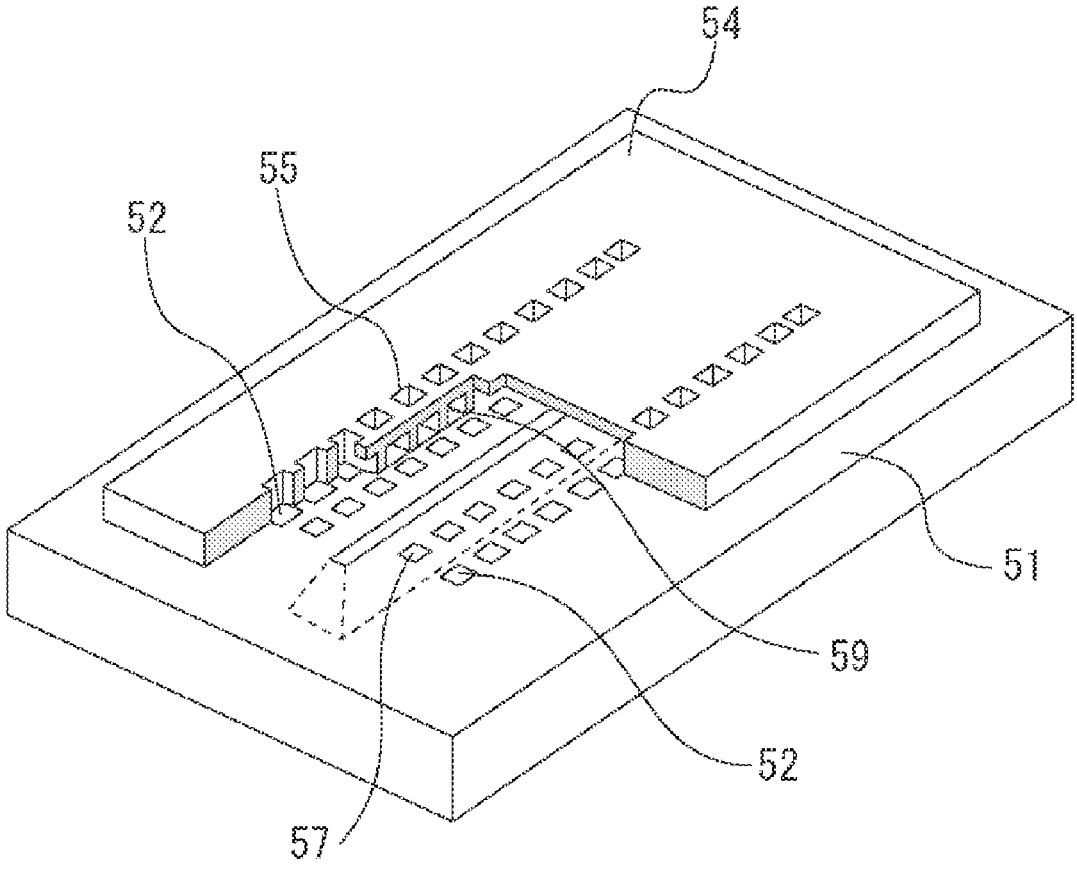
FIG. 9 is a schematic view illustrating an ejection portion of a liquid ejection head applicable to a third exemplary embodiment of the present invention.

According to present exemplary embodiment, an energy generating element for ejecting the liquid is used as the pressurizing means. FIG. 9 is a schematic perspective view of each of the ejection portions of the liquid ejection head according to the present exemplary embodiment. Each ejection portion is equipped with a heater for supplying an energy utilized for ejecting the ink, and only the ejection portion for ejecting the improvement liquid is equipped with a sub-heater 57 as pressurizing means within the ink flow path in addition to the heater.

Figures 10A, 10B, 10C:
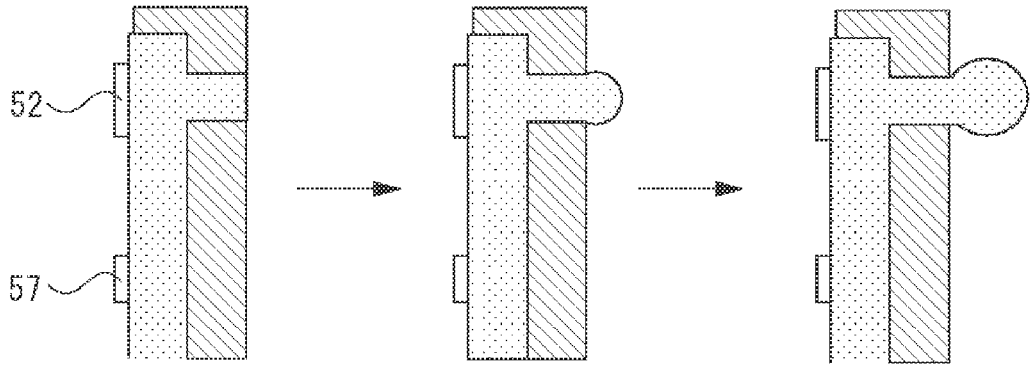
FIGS. 10A to 10C are schematic views illustrating an ejection method in the liquid ejection head according to the third exemplary embodiment of the present invention.

FIGS. 10A through 10C are cross sectional views illustrating a portion of the ejection portion. During non-recording operation, the ink within the ink flow path 59 forms a meniscus at a position in a non-raised state as illustrated in FIG. 10A in a relationship between capillary force and pressure of the ink flow path 59. In this state, the sub-heater 57 (third energy generating element) is driven immediately before bubbling by the heater 52 (second energy generating element) to generate bubbles within the ink flow path, so that a position of the meniscus is brought into a state raised from the orifice surface as illustrated in FIG. 10B. At this time, the drive is adjusted to a degree that the meniscus is not broken, in consideration of the surface tension of the improvement liquid. If the heater is driven from this state, the ejection is performed in a state where the meniscus is raised, and FIG. 10C or later become similar to the ejection state illustrated in FIGS. 6A through 6I, thus floating mists can be suppressed.

In the case of a recording apparatus that ejects a liquid by piezoelectric element, if the ejection operation is performed by applying a preliminary vibration by the piezoelectric element, and raising the meniscus, the similar effects can be obtained.

The ejection with fewer mists can be realized by utilizing the energy generating elements and raising the meniscus, as described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-139371 filed Jun. 10, 2009, which is hereby incorporated by reference herein in its entirety.

What is claimed is:

1. A method for ejecting a liquid using a liquid ejection head, the method comprising the steps of:

providing the liquid ejection head including a first ejection port configured to eject an ink containing a color material, a first energy generating element configured to generate energy utilized for ejecting the ink from the first ejection port, a second ejection port configured to eject an improvement liquid for improving recording property of the ink, and a second energy generating element configured to generate energy utilized for ejecting the improvement liquid from the second ejection port;

ejecting the ink from the first ejection port by driving the first energy generating element;

ejecting the ink from the first ejection port by driving the first energy generating element in a state where the liquid level of the ink in the first ejection port is on the same surface on which the first ejection port is formed or is retracted to an opposite side to the liquid ejection direction to the surface; and ejecting the improvement liquid from the second ejection port by driving the second energy generating element in a state where the liquid level of the improvement liquid is raised in the liquid ejection direction to a surface where the second election port is formed.

2. A liquid ejection head comprising:

a first ejection port configured to eject an ink containing a color material;

a first energy generating element configured to generate energy utilized for ejecting an ink from the first ejection port;

a second ejection port configured to eject an improvement liquid for improving recording property of the ink;

a second energy generating element configured to generate energy utilized for ejecting the improvement liquid from the second ejection port; and a third energy generating element which corresponds to the second ejection port in addition to the second energy generating element and is configured to control a position of the liquid level of the improvement liquid, wherein the improvement liquid is ejected from the second ejection port by driving the second energy generating element in a state where a liquid level of the improvement liquid in the second ejection port has moved forward in a liquid ejection direction than a liquid level of the ink in the first ejection port when the first energy generating element is driven.

3. A liquid ejection apparatus comprising:

a liquid ejection head which includes a first ejection port configured to eject an ink containing a color material, a first energy generating element configured to generate energy utilized for ejecting the ink from the first ejection port, a second ejection port configured to eject an improvement liquid for improving recording property of the ink, and a second energy generating element configured to generate energy utilized for ejecting the improvement liquid from the second ejection port; and a unit configured to generate a difference between a position of a liquid level of the ink in the first ejection port when the first energy generating element is driven and a position of a liquid level of the improvement liquid in the second ejection port when the second energy generating element is driven, wherein the improvement liquid is ejected from the second ejection port by driving the second energy generating element in a state where the liquid level of the improvement liquid in the second ejection port has moved forward in a liquid ejection direction by the unit than the liquid level of the ink in the first ejection port when the first energy generating element is driven.

4. The liquid ejection apparatus according to claim 3, wherein the unit is a pump for introducing air into an improvement liquid tank or discharging air from the improvement liquid tank.

5. The liquid ejection apparatus according to claim 3, wherein the unit is an elevating unit configured to move the improvement liquid tank in a vertical direction relative to the liquid ejection head.

6. A method for ejecting a liquid using a liquid ejection head, wherein the liquid ejection head includes a first liquid ejection head configured to eject a main droplet of a first liquid and a plurality of minute liquid droplets accompanying the main droplet, and a second liquid ejection head configured to eject a main droplet of a second liquid and a plurality of minute liquid droplets accompanying the main droplet, and a number of the minute liquid droplets ejected from the second liquid ejection head is smaller than a number of the minute liquid droplets ejected from the first liquid ejection head, the method comprising the steps of:

ejecting an ink containing a color material from the first liquid ejection head; and ejecting an improvement liquid for improving recording property of the ink from the second liquid ejection head.

* * * * *